US009341405B2

(12) United States Patent
Qu et al.

(10) Patent No.: US 9,341,405 B2
(45) Date of Patent: May 17, 2016

(54) DEFROST CONTROL USING FAN DATA

(71) Applicant: Lennox Industries Inc., Richardson, TX (US)

(72) Inventors: Yi Qu, Coppell, TX (US); H. Gene Havard, Terrell, TX (US); Jon Douglas, Lewisville, TX (US); Jeff Mangum, Argyle, TX (US)

(73) Assignee: Lennox Industries Inc., Richardson, TX (US)

( * ) Notice: Subject to any disclaimer, the term of this patent is extended or adjusted under 35 U.S.C. 154(b) by 327 days.

(21) Appl. No.: 13/690,463

(22) Filed: Nov. 30, 2012

(65) Prior Publication Data

US 2014/0150477 A1 Jun. 5, 2014

(51) Int. Cl.

| | |
|---|---|
| ***F25D 21/02*** | (2006.01) |
| ***F25D 17/06*** | (2006.01) |
| ***F25D 21/00*** | (2006.01) |
| ***F25B 47/02*** | (2006.01) |
| *F24F 11/00* | (2006.01) |

(52) U.S. Cl.

CPC ..... *F25D 21/02* (2013.01); *F25B 47/02* (2013.01); *F25D 17/06* (2013.01); *F25D 21/002* (2013.01); *F24F 2011/0087* (2013.01); *F25B 2700/11* (2013.01); *F25B 2700/21174* (2013.01); *F25D 21/006* (2013.01)

(58) Field of Classification Search

CPC ..... F25D 21/02; F25D 21/002; F25D 21/006; F24F 2011/0087; F25B 2700/11; F25B 2313/0293; F25B 2313/0294

USPC ..... 62/80, 128, 139, 140, 150, 151, 157, 62/234

See application file for complete search history.

(56) References Cited

U.S. PATENT DOCUMENTS

| | | | | |
|---|---|---|---|---|
| 3,643,457 | A * | 2/1972 | Winkler | 62/140 |
| 4,007,603 | A | 2/1977 | Gustafsson | |
| 4,400,949 | A * | 8/1983 | Kinoshita et al. | 62/140 |
| 5,440,890 | A * | 8/1995 | Bahel et al. | 62/81 |
| 5,799,498 | A * | 9/1998 | Park | 62/154 |
| 5,816,054 | A * | 10/1998 | Yoo et al. | 62/80 |
| 6,715,304 | B1 * | 4/2004 | Wycoff | 62/155 |
| 2007/0089435 | A1 * | 4/2007 | Singh et al. | 62/129 |
| 2012/0221150 | A1 * | 8/2012 | Arensmeier | 700/276 |
| 2012/0260739 | A1 | 10/2012 | Yang et al. | |

FOREIGN PATENT DOCUMENTS

EP 0147825 A2 7/1985

OTHER PUBLICATIONS

PCT International Search Report for related PCT/US2013/072042, dated Feb. 5, 2014, 5 pages.

PCT Partial International Search Report, issued as part of PCT Invitation to Pay Additional Fees and, Where Applicable, Protest Fee for related PCT/US2013/072042, dated Feb. 24, 2014, 5 pages.

* cited by examiner

*Primary Examiner* — Jonathan Bradford

(74) *Attorney, Agent, or Firm* — Bell Nunnally & Martin LLP; Craig J. Cox

(57) ABSTRACT

In various implementations, frost in a vapor compression system may be controlled. A property of a fan may be determined. A determination may be made whether a frost event and/or a nonfrost event has occurred based at least partially on the determined fan property.

19 Claims, 3 Drawing Sheets

DEFROST CONTROL USING FAN DATA

TECHNICAL FIELD

The present disclosure relates to defrost control, and more particularly to defrost control based at least partially on fan data.

BACKGROUND

Vapor compression systems may allow operations with heating and/or cooling cycles. Vapor compression systems may comprise two heat exchangers, a compressor, and/or valves coupled together with tubing to form a refrigerant circuit. Vapor compression systems may further comprise other components, such as fans that blow air across the two heat exchangers.

Heat pumps of air conditioning systems may be vapor compression systems that may allow operations with heating and cooling cycles. During a cooling cycle of the heat pump, cool air may be provided by blowing air (e.g., from a fan) across a first heat exchanger (e.g., indoor coil) that acts as an evaporator to evaporate liquid refrigerant. A temperature and/or humidity of the air may be reduced and the cool air may be provided to a location, such as a home, for example. Moisture removed from the air may collect on the evaporator (e.g., as liquid flowing to a drain pan). The gaseous refrigerant may exit the first heat exchanger, be compressed by a compressor, and then delivered to a second heat exchanger (e.g., outdoor coil) acting as a condenser. The second heat exchanger may condense the gaseous refrigerant, for example by allowing air blowing across the second heat exchanger to remove heat from the gaseous refrigerant.

To allow the heat pump to operate in a heating cycle, the heat pump system may include a reversing valve to allow the refrigerant to flow in the opposite direction as the refrigerant flow in the cooling cycle. For example, hot air may be provided by blowing air across the first heat exchanger (e.g., indoor unit), which acts as a condenser (e.g., the air may remove heat from the refrigerant and allow the refrigerant to condense). The hot air may be provided to a location by the system. The second heat exchanger (e.g., outdoor unit) may act as an evaporator and the temperature of the air may be cooler when leaving the second heat exchanger than when entering the second heat exchanger. When outdoor ambient temperatures are cold, the temperature of the second heat exchanger (e.g. outdoor unit and evaporator) may drop below freezing, such that moisture removed from the air may accumulate as frost on one or more surfaces of the second heat exchanger.

Another type of vapor compression system is a refrigeration system, which operates in a similar manner to a heat pump during a heating cycle. In a refrigeration system, cooling is provided to a refrigerated compartment (e.g. a walk-in cooler) by blowing air (e.g. from a fan) across a first heat exchanger that acts as an evaporator to evaporate liquid refrigerant. A temperature of the air may be reduced and the cool air may be provided to a location (e.g. at least a portion of the refrigerated compartment). Since the ambient air temperature within a refrigerated compartment is generally cold, the temperature of the air flowing over the first heat exchanger (e.g. evaporator) may drop below freezing, such that moisture removed from the air may accumulate as frost on one or more surfaces of the second heat exchanger.

SUMMARY

In various implementations, one or more fan properties of a vapor compression system (e.g., an evaporator fan) may be determined. A determination may be made whether a frost event has occurred based at least partially on at least one of the determined fan properties.

Implementations may include one or more of the following features. The vapor compression system (e.g., heat pump in a refrigeration system, and/or air conditioning unit) may be allowed to operate in response to a request. One or more of the fan properties may include fan speed, air flow rate, external static pressure, input power, change in fan speed, change in air flow rate, change in external static pressure, and/or change in input power. The vapor compression system may be allowed to operate in a defrost mode, if the frost event has been determined to have occurred. An evaporator air inlet temperature of the vapor compression system-may be determined. In some implementations, the evaporator inlet temperature may be approximately equal to the ambient temperature (e.g., in a heat pump air conditioner application). In some implementations, the evaporator inlet temperature may be approximately equal to the compartment temperature (e.g., in a refrigeration unit). A determination may be made whether a frost event has occurred and a determination may be made whether the frost event has occurred based at least partially on the evaporator inlet temperature. A determination may be made whether a nonfrost event has occurred based at least partially on at least one of the properties of the fan. The nonfrost event may include soiling of the coil. Evaporator inlet temperature and/or time may be determined, and a determination may be made whether a frost event has occurred based at least partially on at least one of the determined evaporator inlet temperature and/or the determined time. At least one of the determined properties may be compared to a predetermined property value. A determination may be made whether a frost event has occurred based at least partially on the comparison of at least one of the determined properties to the predetermined property value.

In various implementations, a vapor compression system may include a fan, a sensor, and a management module. A sensor may measure one or more fan properties. A management module may determine whether a frost event has occurred at least partially based on one or more of the measured fan properties.

Implementations may include one or more of the following features. The fan may include an outdoor fan of a heat pump. The fan may include the compartment fan of a refrigeration unit. At least one of the properties may include fan speed, air flow rate, external static pressure, input power, change in fan speed, change in air flow rate, change in external static pressure, and/or change in input power. The system may include a memory that may store one or more predetermined property values. The management module may allow a defrost operation if a frost event has occurred. The management module may determine if a nonfrost event has occurred based at least partially on one or more of the measured fan properties. The system may include an additional sensor to measure an evaporator inlet temperature.

In various implementations, one or more fan properties of a vapor compression system may be determined and a determination may be made whether a frost event has occurred based at least partially on at least one of the determined fan properties. A signal to allow one or more defrost operations to occur may be transmitted if a frost event has occurred. A defrost operation may reduce accumulation of frost on at least a portion of the vapor compression system.

Implementations may include one or more of the following features. A determination may be made whether a nonfrost event has occurred based at least partially on at least one of the determined fan properties. Evaporator inlet temperature and/ or time may be determined, and a determination may be made whether a frost event has occurred at least partially based on at least one of the determined evaporator inlet temperature and/or determined time.

The details of one or more implementations are set forth in the accompanying drawings and the description below. Other features, objects, and advantages of the implementations will be apparent from the description and drawings.

BRIEF DESCRIPTION OF THE DRAWINGS

For a more complete understanding of this disclosure and its features, reference is now made to the following description, taken in conjunction with the accompanying drawings, in which.

Like reference symbols in the various drawings indicate like elements.

DETAILED DESCRIPTION

A vapor compression system may be utilized in various settings, such as residential air conditioners, commercial air conditioners, and/or refrigeration systems, for example. During use of a vapor compression system under conditions where there are low evaporator inlet temperatures (e.g., such as heat pump heating cycles during low ambient outdoor temperatures), a frost event may occur in which frost (e.g., ice) may accumulate on surfaces of component(s) of the vapor compression system, such as the evaporator.

When outdoor temperatures are cold, the temperature of the evaporator may drop below a freezing point for water and may cause moisture removed from the air to accumulate as frost on a surface of the evaporator. In some implementations, a vapor compression system, such as a refrigeration system, may operate in a similar manner to a heat pump in a heating mode. Cooling may be provided to a refrigerated compartment by blowing air (e.g., from a fan) across a first heat exchanger (e.g., indoor coil) that acts as an evaporator to evaporate liquid refrigerant. A temperature of the air may be reduced and the cool air may be provided to a location. When the temperature of the air flowing over the evaporator is low, the moisture from the air may accumulate as frost. The gaseous refrigerant may exit the first heat exchanger, may be compressed by a compressor, and then delivered to a second heat exchanger (e.g., outdoor coil) acting as a condenser. The second heat exchanger may condense the gaseous refrigerant, for example, by allowing air blowing across the second heat exchanger to remove heat from the gaseous refrigerant.

In some implementations, a housing and/or a coil (e.g., tubes and/or fins) in a heat exchanger (e.g., outdoor unit) may accumulate ice when evaporator inlet temperatures are at or below approximately −40 degrees Fahrenheit. The evaporator inlet temperature may be associated with an ambient temperature in air conditioning applications and/or may be associated with compartment temperature in a refrigeration unit. When frost accumulates on surfaces of components of the vapor compression system (e.g., the evaporator), the performance of the vapor compression system may be reduced and/or wear may increase on components of the vapor compression system. In some implementations, frost accumulation may inhibit operations of the vapor compression system. To reduce the impact of a frost event on surfaces of the vapor compression system, such as the evaporator, a defrost cycle may be allowed.

Figure 1:
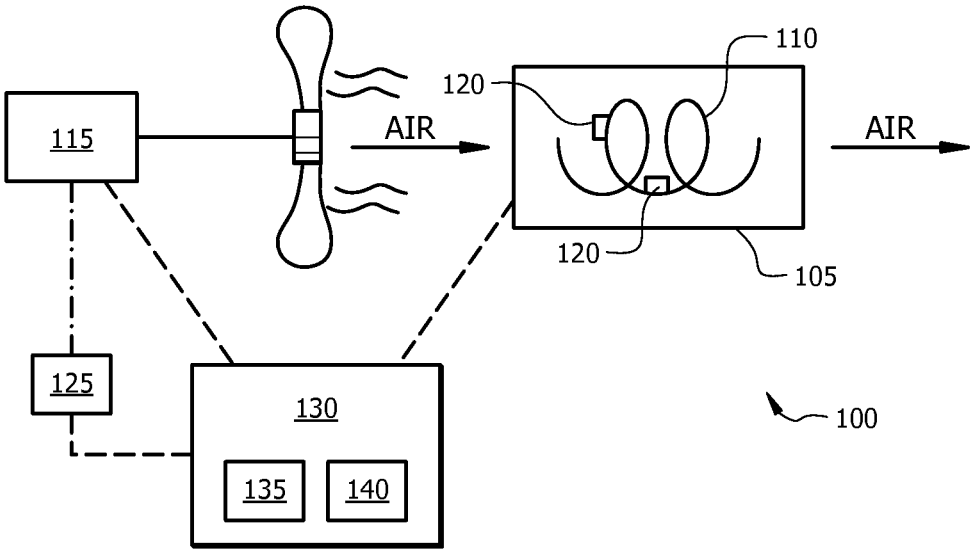
FIG. 1 illustrates an implementation of an example portion of a vapor compression system.

FIG. 1 illustrates an implementation of an example portion 100 of a vapor compression system. The vapor compression system may include two heat exchangers, one heat exchanger may perform operations as an evaporator (e.g., evaporator section 105) and another heat exchanger may perform operations as a condenser (e.g., condenser section). In some implementations, such as in a vapor compression system with a reversing valve, which of the heat exchangers performs the functions of the evaporator section and/or condenser section may change based on the direction of flow allowed by the reversing valve.

As illustrated, the evaporator section 105 may include a heat exchanger 110 (e.g., coil), through which refrigerant flows. The evaporator section 105 may be an outdoor unit of a heat pump or the evaporator of a refrigeration system. When the heat exchanger 110 acts as an evaporator (e.g., during a heating cycle), refrigerant in the heat exchanger is evaporated, and when the heat exchanger acts as a condenser (e.g., during a cooling cycle), the refrigerant in the heat exchanger is condensed.

A fan 115 may provide an air flow to the heat exchanger 110. The air from the fan 115 may flow through the heat exchanger 110 and allow heat transfer between the air and the refrigerant in the heat exchanger 110. During use, item(s) 120 (e.g., frost, ice, dirt, and/or debris) may accumulate on surfaces of the evaporator section 105, such as the heat exchanger 110, fan 115, and/or a housing. For example, the heat exchanger 110 may become soiled (e.g., dirt and/or debris) and/or frost may accumulate on the coil 110.

A sensor 125 may be coupled to the fan 115. The sensor 125 may include tachometer, air flow meters, pressure sensors, temperature sensors, timers, and/or any other appropriate sensor. The sensor 125 may measure and/or monitor one or more fan properties (e.g., fan speed, air flow rate, temperature, external static pressure, and/or input power). The sensor 125 may measure time (e.g., time elapsed and/or absolute time).

The sensor 125 may be coupled to a controller 130. The controller 130 may be a computer configured to perform one or more operations of the vapor compression system. The controller 130 may include a memory 135 and a processor 140. The processor 140 may execute instructions and manipulate data to perform operations of the controller 130. The processor 140 may include a programmable logic device, a microprocessor, or any other appropriate device for manipulating information in a logical manner, and memory 135 may include any appropriate form(s) of volatile and/or nonvolatile memory, such as RAM and/or Flash memory. Data such as predetermined values and/or ranges for fan properties, temperatures, times, frost event indicators (e.g., temperatures, pressures, times, other properties, and/or combinations thereof), fan curves, and/or any other appropriate data, may be stored in the memory 135.

Various software modules may be stored on the memory 135 and be executable by the processor 140. For example, instructions, such as operating systems and/or modules such as management modules may be stored in the memory 135. The management module may manage operations and/or components (e.g., heat exchangers, valves, lines, and/or compressors) of the vapor compression system, such as responding to requests and/or operating a reversing valve of the vapor compression system. The management module may manage and/or control defrost operations, such as monitor fan properties, identify frost events, transmit signals to initiate defrost operations, determine appropriate responses to frost events, and/or transmit notifications. In various implementations, management module may include various modules and/or sub-modules.

The controller 130 may include a communication interface that may allow the controller 130 to communicate with components of the vapor compression system, other repositories, and/or other computer systems. The communication interface may transmit data from the controller 130 and/or receive data from other components, other repositories, and/or other computer systems via network protocols (e.g., TCP/IP, Bluetooth, and/or Wi-Fi) and/or a bus (e.g., serial, parallel, USB, and/or FireWire). Operations of the vapor compression system may be stored in the memory 135 and may be updated and/or altered through the communication via network protocols (e.g., remotely through a firmware update and/or by a device directly coupled to the controller 130).

The controller 130 may include a presentation interface to present data to a user, such as though a monitor and speakers. The presentation interface may facilitate receipt of requests for operation from users.

Figure 2:
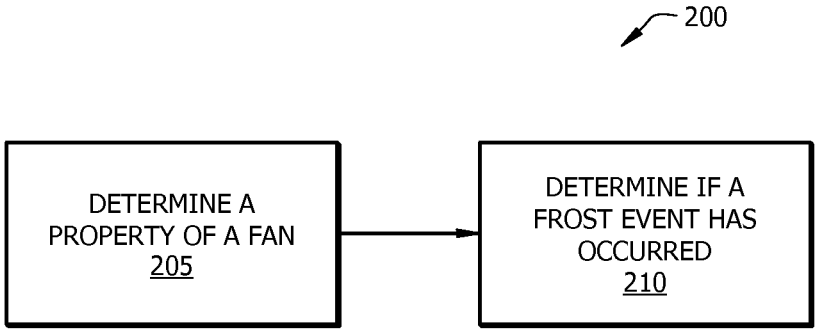
FIG. 2 illustrates an implementation of an example process for defrost control.

FIG. 2 illustrates an implementation of an example process 200 for defrost control. A property of the fan may be determined (operation 205). For example, a fan speed may be set at a predetermined fan speed and a pressure of a fan may be determined. For example, the fan pressure may be measured. The fan pressure drop (e.g., the change in air pressure across the fan) may be determined from other measured properties of the fan.

A determination may be made whether a frost event has occurred (operation 210). For example, a determination may be made whether a frost event has occurred based at least partially on a fan property, time, and/or temperature, such as evaporator inlet temperature (e.g., temperature proximate at least a portion of a heat exchanger and/or a fan). The evaporator inlet temperature may be associated with (e.g., similar to and/or correlated to) an ambient temperature in air conditioning systems. The evaporator inlet temperature may be associated with (e.g., similar to and/or correlated to) a temperature of a refrigeration unit compartment. In some implementations, a change in pressure of the fan may be associated with a change in pressure across a coil of a heat exchanger. For example, the design of the evaporator section may be such that the resistance (e.g., the only resistance and/or a substantial portion of the resistance) to air flow is the resistance of the heat exchanger itself. Thus, a pressure change of airflow across the heat exchanger may be correlated to a change in pressure of a fan.

In some implementations, a nonfrost event (e.g., soiling, such as accumulation of dirt and/or debris) and/or a frost event (e.g., frost and/or ice accumulation) may increase the resistance to the air flow. Since fan pressure changes may be correlated to pressure changes across the heat exchanger (e.g., the coil), measurement of the fan pressure may indicate an increased resistance in the heat exchanger and thus may indicate the presence of a nonfrost event and/or frost event.

In some implementations, a time may be measured and may be utilized to determine whether a nonfrost or frost event is associated with a change in pressure. For example, soiling of a heat exchanger may be a slow occurrence (e.g., months). Thus, if a pressure change occurs during a time period greater than a predetermined soiling time, a nonfrost event may be determined to have occurred. In some implementations, a frost event may occur over a short course of time (e.g., 1-2 hours, 15 minutes, 10 minutes). Thus, if a pressure change occurs during a time period corresponding to a predetermined frost time range, then a frost event may be determined to have occurred. In some implementations, debris may suddenly contact the coils and cause a sudden pressure change. If a pressure change is detected in a sudden period of time (e.g., a predetermined sudden change time range), then a nonfrost event may be determined to have occurred.

In some implementations, a temperature may be utilized to facilitate identification of frost events and/or nonfrost events. Frost events may occur when evaporator inlet temperatures fall below a predetermined low temperature (e.g., below approximately 40 degrees Fahrenheit). A frost event may be determined to occur when a fan property is greater than a predetermined fan property value (e.g., absolute and/or change in) and an evaporator inlet temperature is below a predetermined low temperature. In some implementations, a nonfrost event may be determined to occur when a fan property is not within a predetermined fan property value range and a temperature exceeds a predetermined low temperature (e.g., above 32 degrees Fahrenheit) and/or a predetermined high temperature (e.g., above 40 degrees Fahrenheit).

Process 200 may be implemented by various systems, such as system 100. In addition, various operations may be added, deleted, and/or modified. For example, notification(s) may be transmitted based on the type of event that is determined to have occurred (e.g., frost and/or nonfrost). In some implementations, a property of the fan may be monitored and deviations of a fan property outside a predetermined range of values may be determined. In some implementations, a measured property may be utilized to obtain other properties of the fan.

Figure 3:
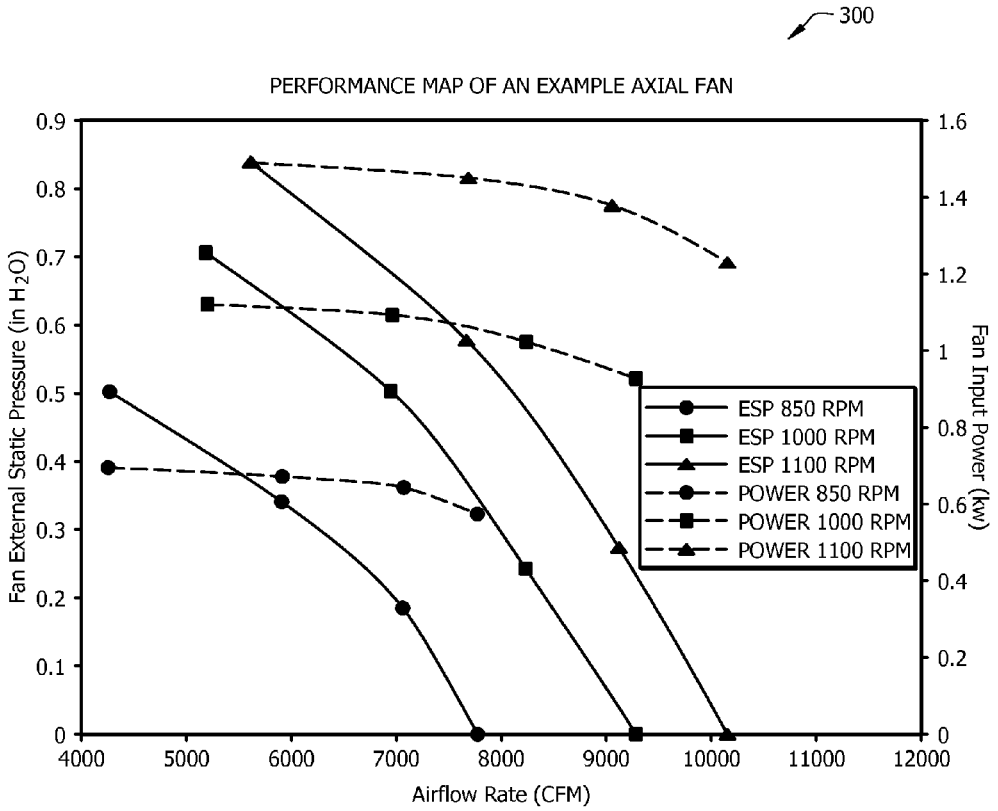
FIG. 3 illustrates an implementation of an example chart for fan properties.

FIG. 3 illustrates an example of a fan curve 300. The fan curve illustrated is a graphical correlation between two or more properties of a fan. For example, as illustrated, if two fan properties (e.g., fan speed and airflow rate) are known, other fan properties may be obtained (e.g., fan external static pressure and/or fan input power). Thus, even if a pressure is not measured, it may be obtained by monitoring other properties of the fan and using a fan curve, such as fan curve 300.

Figure 4:
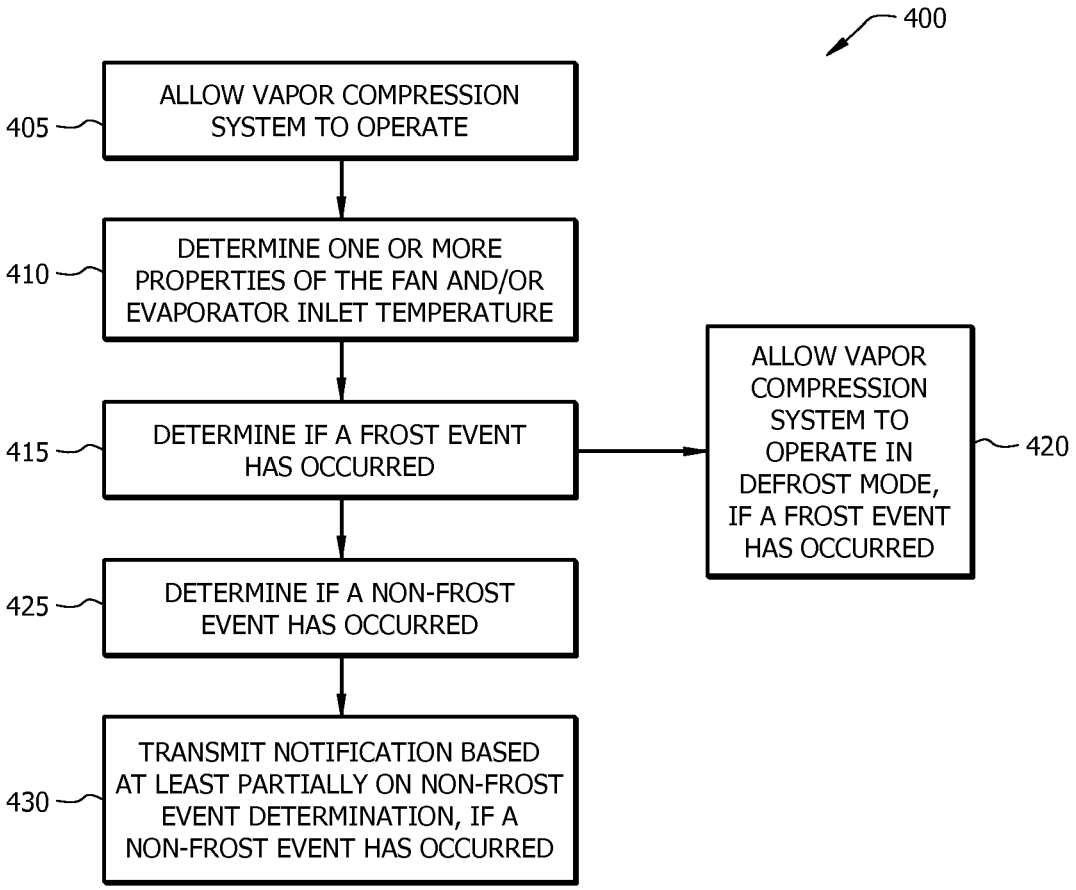
FIG. 4 illustrates an implementation of an example process for defrost control.

FIG. 4 illustrates an implementation of an example process 400 for defrost control. A vapor compression system may be allowed to operate (operation 405). For example, a heating cycle may be allowed to operate and deliver temperature-modified air (e.g., hot air in the case of a heat pump and/or cold air in the case of a refrigeration system) to a location as specified by a user request. The management module of the vapor compression system may receive requests and/or operate the vapor compression system in response to the requests received.

One or more properties of the fan and/or evaporator inlet temperature may be determined (operation 410). For example, sensors may monitor fan properties and/or evaporator inlet temperature(s). In some implementations, one or more known fan properties (e.g., a fan may operate at an approximately constant speed and/or torque) may be utilized to determine unknown fan properties. The controller may receive fan property measurements and determine other fan properties based on the received measurements. For example, the controller may utilize a correlation, such as the fan curve 300 correlation illustrated in FIG. 3, to determine fan pressure and/or changes in fan pressure.

A determination may be made whether a frost event has occurred (operation 415). A management module may retrieve properties for a frost event from a memory of the controller and compare the properties to the measured fan properties and/or temperatures. For example, determined fan properties and/or temperatures may be compared to predetermined fan properties and/or temperatures. In some implementations, a frost event may be determined at least partially based on a time over which a property occurs.

A vapor compression system may be allowed to operate in defrost mode, if a frost event has occurred (operation 420). A defrost mode may include an operation of the vapor compression system that may reduce frost on at least a portion of a component of the evaporator section (e.g., heat exchanger, fan, and/or housing). For example, a heater may be activated to increase a temperature of a portion of a component of the evaporator section (e.g., a heat exchanger, housing or draing pan). In some implementations (e.g., in heat pumps), a management module may transmit a signal to a reversing valve to initiate a cooling cycle. The cooling cycle may allow the heat exchanger, in which frost is accumulating, to operate as a condenser and increase a temperature proximate the heat exchanger. The increased temperature proximate the heat exchanger may reduce the frost accumulation on at least a portion of component(s) of the heat pump.

In some implementations, after the defrost cycle has been allowed, one or more properties of the fan may be monitored and a determination may be made whether the frost event is still occurring. If the frost event is still occurring, an additional defrost cycle (e.g., the same or a different type of defrost operation) may be allowed. If the frost event is no longer occurring, the vapor compression system may be allowed to respond to requests for operation from a user (e.g., return to operations in progress before the frost event and/or new operations based on user requests).

A determination may be made whether a nonfrost event has occurred (operation 425). For example, properties of the fan may be compared to predetermined value(s) for one or more properties and a nonfrost event may be identified. In some implementations, a determination of whether a nonfrost event has occurred may be based at least partially on a fan property, evaporator inlet temperature, and/or time measurement.

A notification may be transmitted at least partially based on the nonfrost event determination, if the nonfrost event has occurred (operation 430). For example, a notification (e.g., visual, tactile, and/or auditory) may be transmitted to a user on a control panel of a heat pump.

Process 400 may be implemented by various systems, such as system 100. In addition, various operations may be added, deleted, and/or modified. In some implementations, process 400 may be performed in combination with other processes, such as process 200. For example, a notification may be transmitted that a defrost operation is occurring. In some implementations, a determination of whether a frost event has occurred may be based on a time measurement. For example, if a fan property change has occurred in a period of time that is within a predetermined frost period of time (e.g., greater than 10 minutes and less than 1 day), then a frost event may be determined to have occurred. If a fan property change has occurred in a period of time outside the predetermined frost period of time, a nonfrost event may be determined to have occurred.

In some implementations, a determination may be made of the type of nonfrost event (e.g., sudden or slow) based on the time period in which the fan property change occurred. For example, a sudden nonfrost event may occur when a period of time for a fan property change is less than a predetermined sudden time period (e.g., less than 30 minutes). The sudden nonfrost event may indicate that debris is caught in the coil, for example. A slow nonfrost event may occur when a period of time in which a fan property changes (e.g., changes by a predetermined amount) is greater than a predetermined slow amount of time (e.g., greater than 1 month). The slow nonfrost event may indicate fowling of the system and/or dirty coils. Notification(s) may be transmitted to a user based on the type of nonfrost event.

In some implementations, a determination of whether a frost event has occurred may be based at least partially on an evaporator inlet temperature. For example, the evaporator inlet temperature may be monitored and when the evaporator inlet temperature and a measured fan property are in predetermined frost ranges, then a determination may be made that a frost event has occurred. For example, in a refrigeration unit, the evaporator inlet temperature may be associated with a temperature in a refrigeration compartment. The evaporator inlet temperature may be monitored and when the temperature is below a predetermined low temperature and a fan property is in a predetermined range, a frost event may be determined to have occurred. In a heat pump of an air conditioner, for example, the evaporator inlet temperature may be associated with an outdoor ambient temperature. Frost events may occur when outdoor ambient temperatures are below a predetermined low outdoor ambient temperature in air conditioners. When the evaporator inlet temperature (e.g., associated with outdoor ambient temperature) is below a predetermined low temperature, and a fan property is in a predetermined range, a frost event may be determined to have occurred.

In some implementations, at least one fan of an evaporator section may include a fixed property. Since a property of the fan may be known, since it is fixed, one property of the fan may be monitored. A determination of whether a frost event has occurred may be based at least partially on the one monitored fan property and the known and/or fixed fan property.

In some implementations, at least one of the fans of an evaporator section may be a constant torque fan. The system may monitor and determine the fan RPM. A determination of whether a frost event has occurred may be based at least partially on the fan RPM (e.g., the fan speed may drop as the external static on the fan increases).

In various implementations, the system may include clients and servers. A client and server are generally remote from each other and typically interact through a communication network. The relationship of client and server arises by virtue of computer programs running on the respective computers and having a client-server relationship to each other. The client may allow a user to access the controller and/or instructions stored on the controller. The client may be a computer system, such as a personal computer, a laptop, a personal digital assistant, a smart phone, or any computer system appropriate for communicating with the controller. For example, a technician may utilize a client, such as a tablet computer, to access the controller. In some implementations, a user may utilize a client, such as a smart phone, to access the controller and request operations.

Although one example of a controller of the vapor compression system has been described (e.g., in FIG. 1), the controller may be implemented through computers such as servers, as well as a server pool. For example, a controller may include a general-purpose personal computer (PC), a Macintosh, a workstation, a UNIX-based computer, a server computer, or any other suitable device. According to one implementation, a controller may include a web server. A controller may be adapted to execute any operating system including UNIX, Linux, Windows, or any other suitable operating system. The controller may include software and/or hardware in any combination suitable to provide access to data and/or translate data to an appropriate compatible format.

Although a single processor in the controller has been described in various implementations, multiple processors may be used according to particular needs, and reference to a processor includes multiple processors where appropriate.

In various implementations, the memory of the controller may include any appropriate memory including a variety of repositories, such as, SQL databases, relational databases, object oriented databases, distributed databases, XML databases, and/or web server repositories. Furthermore, memory may include one or more forms of memory such as volatile memory (e.g., RAM) or nonvolatile memory, such as read-only memory (ROM), optical memory (e.g., CD, DVD, or LD), magnetic memory (e.g., hard disk drives, floppy disk drives), NAND flash memory, NOR flash memory, electrically-erasable, programmable read-only memory (EEPROM), Ferroelectric random-access memory (FeRAM), magnetoresistive random-access memory (MRAM), non-volatile random-access memory (NVRAM), non-volatile static random-access memory (nvSRAM), and/or phase-change memory (PRAM).

Various implementations of the systems and techniques described herein can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the term "machine-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

To provide for interaction with a user, the systems and techniques described herein can be implemented on a computer having a display device (e.g., a CRT (cathode ray tube) or LCD (liquid crystal display) monitor) for displaying information to the user and a keyboard and a pointing device (e.g., a mouse or a track pad) by which the user can provide input to the computer. Other kinds of devices can be used to provide for interaction with a user as well; for example, feedback provided to the user by an output device can be any form of sensory feedback (e.g., visual feedback, auditory feedback, or tactile feedback); and input from the user can be received in any form, including acoustic, speech, or tactile input.

Although users have been described as a human, a user may be a person, a group of people, a person or persons interacting with one or more computers, and/or a computer system.

It is to be understood the implementations are not limited to particular systems or processes described which may, of course, vary. It is also to be understood that the terminology used herein is for the purpose of describing particular implementations only, and is not intended to be limiting. As used in this specification, the singular forms "a", "an" and "the" include plural referents unless the content clearly indicates otherwise. Thus, for example, reference to "a property" includes a combination of two or more properties and reference to "a defrost operation" includes different types and/or combinations of defrost operations. Reference to "a heat exchanger" may include a combination of two or more heat exchangers. As another example, "coupling" includes direct and/or indirect coupling.

Although the present disclosure has been described in detail, it should be understood that various changes, substitutions and alterations may be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A method of distinguishing between a frost condition and a nonfrost condition in a vapor compression system, the method comprising:

determining one or more fan properties of the vapor compression system, the one or more fan properties comprising at least time and pressure;

determining a plurality of pressure measurements at a plurality of time measurements;

determining if an event has occurred based at least partially on at least the plurality of pressure measurements and the plurality of time measurements;

determining if the event is a frost condition or a nonfrost condition based at least in part upon the one or more fan properties, wherein if a pressure change occurs over a long period of time then a determination of a nonfrost condition is made, and if the pressure change occurs over a short period of time then a determination of a frost condition is made; and initiating a defrost cycle if the event is a frost condition.

2. The method of claim 1 further comprising allowing the vapor compression system to operate in response to a request.

3. The method of claim 1 wherein one or more of the fan properties comprises at least one of fan speed, air flow rate, external static pressure, input power, change in fan speed, change in air flow rate, change in external static pressure, or change in input power.

4. The method of claim 1 further comprising allowing the vapor compression system to operate in a defrost mode, if the frost event has been determined to have occurred.

5. The method of claim 1 further comprising determining an evaporator inlet temperature of the vapor compression system; and wherein determining if a frost event has occurred is further based at least partially on the evaporator inlet temperature.

6. The method of claim 1 wherein the one or more fan properties comprises temperature.

7. The method of claim 6 wherein the nonfrost condition comprises soiling of a heat exchanger coil in the vapor compression system.

8. The method of claim 1 further comprising determining evaporator inlet temperature; and wherein determining if a frost event has occurred is further based at least partially on at least the determined evaporator inlet temperature.

9. The method of claim 1 further comprising comparing at least one of the determined properties to a predetermined property value; and wherein determining if a frost event has occurred is based at least partially on the comparison of at least one of the determined properties to the predetermined property value.

10. A vapor compression system comprising:

a fan;

a sensor that measures one or more fan properties, the one or more fan properties comprising at least time and pressure; and a management module that determines whether an event has occurred at least partially based on at least a time measurement and a pressure measurement and further determines that the event is a frost condition when a pressure change occurs over a short time period and a nonfrost condition when the pressure change occurs over a long time period.

11. The system of claim 10 wherein the fan comprises an outdoor fan of an air conditioner.

12. The system of claim 10 wherein the fan comprises a fan of a refrigeration unit.

13. The system of claim 10 wherein the one or more fan properties comprises at least one of fan speed, air flow rate, external static pressure, input power, change in fan speed, change in air flow rate, change in external static pressure, or change in input power.

14. The system of claim 10 further comprising a memory storing one or more predetermined property values.

15. The system of claim 10 wherein the management module further allows a defrost operation if the frost event has occurred.

16. The system of claim 10 wherein the one or more fan properties comprises temperature.

17. The system of claim 10 further comprising an additional sensor to measure an evaporator inlet temperature.

18. A method for managing a vapor compression system, the method comprising:

determining, using sensors and a processor, one or more fan properties of a vapor compression system, the one or more fan properties comprising at least temperature and another property;

determining, using the processor, if an event has occurred based at least partially on at least one of the determined fan properties;

determining, using the processor, that the event is a frost condition if a temperature measurement is below a predetermined low temperature and another property measurement is above a predetermined fan property value;

determining, using the processor, that the event is a nonfrost condition if the temperature measurement is above the predetermined low temperature and the other property measurement is not within a predetermined fan property value range; and transmitting, using the processor, a signal to allow one or more defrost operations to occur if the event is a frost event, wherein a defrost operation is configured to reduce accumulation of frost on at least a portion of the vapor compression system.

19. The method of claim 18 wherein the instructions are further operable to cause the processor to perform operations comprising:

determining evaporator inlet temperature, and wherein determining if the frost event has occurred is at least partially based on the determined evaporator inlet temperature.

* * * * *